US006542144B2

(12) United States Patent
Kogure et al.

(10) Patent No.: US 6,542,144 B2
(45) Date of Patent: Apr. 1, 2003

(54) FLAT PANEL DISPLAY HAVING SCANNING LINES DRIVER CIRCUITS AND ITS DRIVING METHOD

(75) Inventors: Hideyuki Kogure, Fukaya (JP); Kazuo Nakamura, Kitamoto (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 151 days.

(21) Appl. No.: 09/753,562

(22) Filed: Jan. 4, 2001

(65) Prior Publication Data

US 2001/0017608 A1 Aug. 30, 2001

(30) Foreign Application Priority Data

Jan. 11, 2000 (JP) ..... 2000-002796

(51) Int. Cl.[7] ..... G09G 3/36

(52) U.S. Cl. ..... 345/98; 345/99; 345/100; 345/205; 345/213; 326/60; 326/80; 326/81; 326/82; 326/83; 326/86

(58) Field of Search ..... 345/98, 99, 100, 345/205, 213; 326/60, 80, 81, 82, 83, 86

(56) References Cited

U.S. PATENT DOCUMENTS

| | | | | |
|---|---|---|---|---|
| 5,206,634 A | * | 4/1993 | Matsumoto et al. | 340/784 |
| 5,399,915 A | * | 3/1995 | Yahata | 327/108 |
| 5,723,986 A | * | 3/1998 | Nakashiro et al. | 326/81 |
| 6,433,582 B2 | * | 8/2002 | Hirano | 326/68 |
| 6,445,226 B2 | * | 9/2002 | Taniguchi | 327/112 |

* cited by examiner

*Primary Examiner*—Richard Hjerpe
*Assistant Examiner*—Jennifer T. Nguyen
(74) *Attorney, Agent, or Firm*—Oblon, Spivak, McClelland, Maier & Neustadt, P.C.

(57) ABSTRACT

The scanning lines driver circuit according to this invention comprises a timing circuit unit to which voltage is supplied from a power source, a level shifter circuit unit that generates voltage for driving pixel switching devices, a plurality of gate voltage sources that connect power sources to the level shifter circuit unit and a gate buffer unit that supplies the output from the level shifter circuit unit to scanning lines. The level shifter circuit unit is a series of flip-flop type level shifter circuits that conduct level shifting for each gate voltage source and transistors controlled by a power source detection circuit are inserted in parallel in the outputs from those level shifter circuits.

1 Claim, 7 Drawing Sheets

FLAT PANEL DISPLAY HAVING SCANNING LINES DRIVER CIRCUITS AND ITS DRIVING METHOD

CROSS-REFERENCE TO RELATED APPLICATIONS

This application is based upon and claims the benefit of priority from the prior Japanese Patent Application No. 2000-002796, filed Jan. 11, 2000, the entire contents of which are incorporated herein by reference.

BACKGROUND OF THE INVENTION

This invention relates to a flat panel display having an embedded driver circuit where scanning lines driver circuits and signaling lines driver circuits are integrated with TFT pixels, and to its driving method.

The active matrix type liquid crystal display (hereafter, AM-LCD) using semiconductor switching devices is one of the representative flat panel liquid crystal displays. In particular, the thin film transistor type liquid crystal display (hereafter, TFT-LCD), which uses thin film transistors (hereafter, TFTs) as switching devices made of amorphous-silicon thin films or poly-silicon thin films, has been intensively developed.

This type of TFT-LCD employs a method for controlling voltage applied on the liquid crystal in each pixel by the use of semiconductor switching devices fabricated on a transparent insulator substrate, for example, glass. Such displays, featured by clear images, are widely used as OA terminals and graphic displays for TV screens.

In recent years, TFT-LCDs have been developed where the scanning lines driver circuits and signaling driving lines driver circuits are fabricated and integrated with TFT pixels on a transparent insulator substrate, instead of placing such circuits in the outside of the transparent insulator substrate of the liquid crystal display. Poly-silicon-based TFT (hereafter, p-SiTFT) is particularly employed in this type of circuit configuration.

As shown in FIG. 10, the scanning lines driver circuit is comprised of a timing circuit 2A made of shift registers, a level shifter circuit 2B that shifts the logic-based source voltage to the operation voltage for TFT pixels, and a buffer circuit 2C corresponding to the load of scanning lines.

The TFT-LCD panel having the embedded driving circuits where the scanning lines driver circuits and TFT pixels are fabricated together on a transparent insulator substrate is under development to attain larger panel sizes and higher resolution.

As the panel size becomes larger, the length of each scanning line becomes longer. For higher resolution, the pulse intervals in driving scan lines and accordingly the lateral blanking time are shortened.

As the scanning lines become longer, their resistance and capacitance increase, leading to longer delay in the scanning lines driver pulse.

Quality degradation such as brightness fluctuations occurs in the direction of scanning lines because of the above problems.

Therefore, the load in scanning lines should be reduced and the delay in scanning lines driver pulses should be shortened to provide higher resolution in the display.

A measure to handle such problems, as shown in FIG. 11, is that the scanning lines driver circuit is configured to supply driver pulses from both sides of the display panel by mounting scanning line driver circuits on both sides of the display panel, instead of supplying driver pulses from either side of the display panel for the whole length of each scanning line by mounting the scanning line driver circuit on either side of the display panel. When the two methods compared with each other for a panel of a given size, the magnitude of the maximum pulse delay in the both-side driving method becomes one forth of that of the one-side driving method, because the resistance and capacitance in each scanning line become half in the both-side driving method.

This is an attempt to reduce the delay in scanning line pulses by mounting the scanning line driver circuits on both sides of the panel in order to raise the size and resolution of panels.

As demonstrated above, the method of driving scanning lines from both sides of the panel is effective to raise the size and resolution of panels. However, the magnitudes of two scanning lines driver pulses sent from both scanning lines driver circuits (those mounted on both sides of the panel) cannot be equalized, because it is difficult to completely eliminate the difference in magnitudes of those two scanning lines driver pulses due to a probability reason. As a result, when there is a difference in two voltage outputs, an electric current flows from the higher voltage side to the lower voltage side between the two scanning line driver circuits, causing a rise in power consumption and damage in the driving circuits.

It has been found that the reason why different voltages of scanning lines driver pulses are generated between the two scanning lines driver circuits is an instability in operation at power-on in the level shifter in the block circuit shown in FIG. 10.

BRIEF SUMMARY OF THE INVENTION

The present invention is made to solve the above problem, and accordingly, the object of this invention is to provide scanning lines driver circuits and their driving method that can display high quality of images on the screens of large flat panel displays with high resolution without damaging their circuits.

This invention provides a scanning lines driver circuit that provides scanning lines driver signals for the scanning lines on active matrix type liquid crystal displays having a plurality of scanning lines, a plurality of image signaling lines crossing orthogonal to these scanning lines and pixel switching devices connected to these scanning lines and image signaling lines, comprising:

a first voltage source;

a plurality of gate voltage sources;

a power source detection circuit;

transistors controlled by the power source detection circuit;

a timing generation circuit to which voltage is supplied from the first voltage source;

a level shifter circuit that is connected to the first voltage source and a plurality of gate voltage sources and generates voltage for driving the image switching devices; and a gate buffer that supplies the output voltage from the level shifter circuit to the scanning lines;

wherein the level shifter circuit is made of serially connected flip-flop type level shifter circuits that shift voltage levels for each of the gate voltage sources and the transistors are arranged in parallel with the outputs of the level shifter circuits.

Further, this invention provides a power-on sequence for the scanning lines driver circuit that provides scanning lines driver signals for the scanning lines on active matrix type liquid crystal displays having a plurality of scanning lines, a plurality of image signaling lines crossing orthogonal to these scanning lines and pixel switching devices connected to these scanning lines and image signaling lines, comprising:

a first voltage source;

a plurality of gate voltage sources;

a power source detection circuit;

transistors controlled by the power source detection circuit;

a timing generation circuit to which voltage is supplied from the first voltage source;

a level shifter circuit that is connected to the first voltage source and a plurality of gate voltage sources and generates voltage for driving the image switching devices; and a gate buffer that supplies the output voltage from the level shifter circuit to the scanning lines;

comprising the steps of:

turning on the first voltage source that enables the operation of the timing generation circuit; and shifting each gate voltage by turning on each gate voltage in the same order as that of serially connected level shifter circuits.

Yet further, this invention provides a scanning lines driver circuit that provides a plurality of scanning lines in sequence with scanning pulses including high and low level voltages, comprising:

a first level shifter circuit and a second level shifter circuit which are serially connected;

a first transistor and a second transistor which are connected in parallel to the outputs of the first and second level shifter circuits; and a power source detection circuit that controls the first and second transistors.

Additionally, this invention provides a flat display driving method for the flat panel display having a plurality of signaling and scanning lines, pixel electrodes electrically connected to the signaling lines via switching devices connected to the scanning lines, and a first scanning lines driver circuit and a second scanning lines driver circuit that output in sequence scanning pulses including high and low levels of voltage, comprising the steps of:

shifting a first standard voltage to a first voltage by a first level shifter circuit; and controlling the operation of a second level shifter circuit when a second standard voltage is shifted to a second voltage by a second level shifter circuit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The foregoing and other objects, features and advantages as well as the presently preferred embodiment thereof will become more apparent from reading of the following description in connection with the accompanying drawings.

Figure 1:
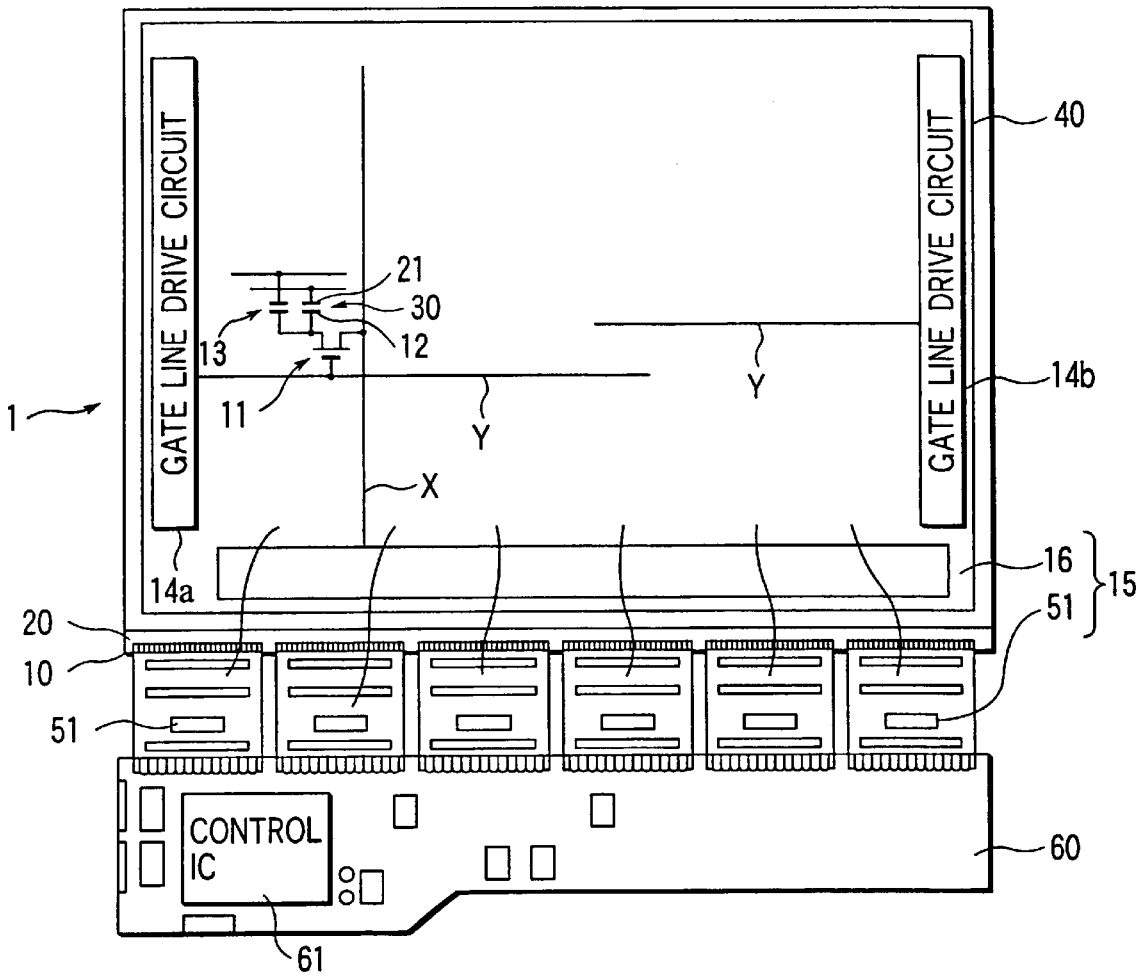
FIG. 1 is a schematic cross section illustrating an example of the liquid crystal displays (flat panel displays) to which the scanning lines driver circuits according to the present invention will be applied.

As shown in FIG. 1, the liquid crystal display 1 is a transparent type liquid crystal display (p-SiTFT-LCD) that uses poly-Silicon TFT in TFT pixels, of a 15-inch diagonally effective display area.

The liquid crystal display 1 comprises an array substrate 10, the other substrate 20 opposed to the array substrate 10 with a predetermined interval, and a liquid crystal layer 30 which is placed between the two substrates via a directional thin film. Between the array substrate 10 and the opposed substrate 20, a space is formed with a seal material 40 applied on their rims to hold the liquid crystal layer 30.

The array substrate 10 has a plurality of gate (scanning) lines Y extending to the lateral direction, a plurality of signaling lines X extending to the vertical direction, thin film transistor pixel, namely, TFT pixel 11, fabricated at the intersection of the scanning line X and the signaling line Y, and a pixel electrode 12 fabricated in each pixel surrounded by each scanning line X and signaling line Y.

The gate electrode of the TFT pixel 11 is connected to the scanning line Y, while the source electrode is connected to the signaling line X. The drain electrode is formed in parallel with the pixel electrode 12 and the pixel electrode 12, each being connected to the supplemental capacitance lines that supply supplemental capacitance 13. One of the ends of the pixel electrode 12 is coupled with the opposed electrode 21 on the opposed substrate 20.

Scanning lines driver circuits 14*a*, 14*b* that drive the scanning line Y are fabricated on the array substrate 10 in a single piece together with the substrate itself on the oppose two sides (parallel with the signaling line Y) of the array substrate 10 by the process employed to form TFT pixel 11.

The signaling lines driver circuit 15 that drive the signaling lines X comprises a plurality of signaling lines driver ICs 51 mounted on flexible circuit boards, TCPs (Tape Carrier Packages) 50, and a selection circuit 17 that is to work as a selection method and fabricated by the same process as that used in forming TFT pixels on the array substrate 10.

On the other side of TCP 50, opposed to the array substrate 10, a PCB substrate 60 is connected as an external circuit substrate. On the PCB substrate 60, there are components such as a control IC 61 that provides control signals and data signals synchronized with the control signals based on the standard clock signals and digital data signals entered from the outside and power source circuits mounted.

Figure 2A:
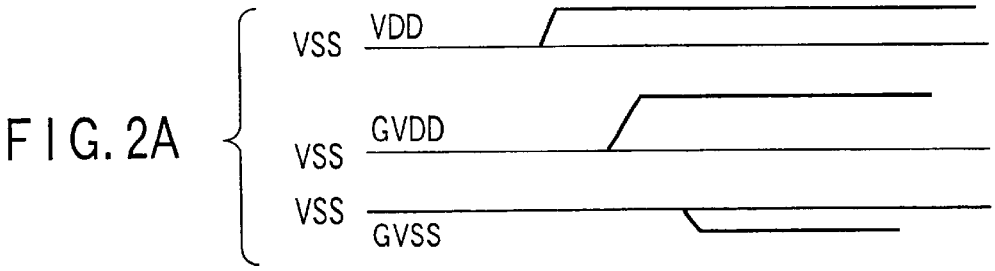
FIGS. 2A and 2B are schematic diagrams illustrating the level shifter circuit installed in the scanning lines driver circuits providing scanning lines driver signals to the scanning lines in the liquid display of FIG. 1 and the power-on sequence for providing GVDD and GVSS which are the driving currents to drive each TFT.
Figure 2B:
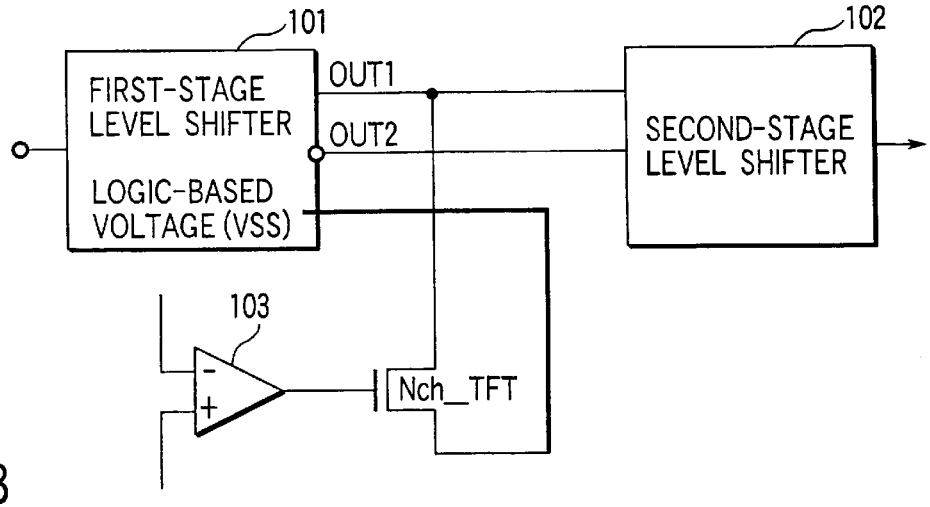
Figure 3A:
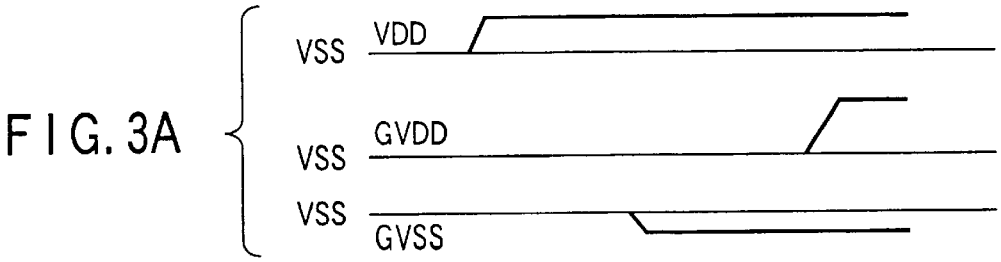
FIGS. 3A and 3B are schematic diagrams illustrating the level shifter circuit installed in the scanning lines driver circuits providing scanning lines driver signals to the scanning lines in the liquid display of FIG. 1 and the power-on sequence for providing GVDD and GVSS which are the driving currents to drive each TFT.
Figure 3B:
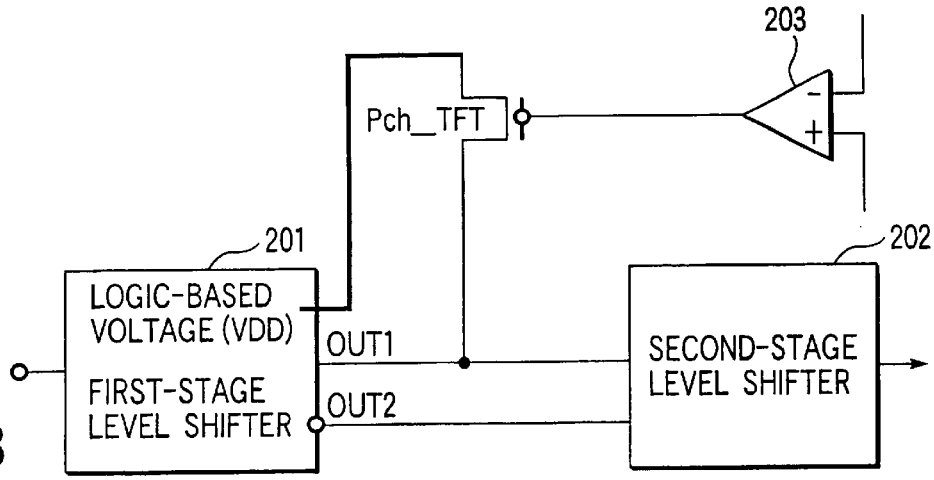

FIGS. 2A, 2B, 3A and 3B are schematic diagrams illustrating the level shifter circuits installed in the scanning lines driver circuits 14*a*, 14*b* that drive the scanning lines Y of the p-SiTFT-LCD shown in FIG. 1 and the power-on sequences. As shown in FIGS. 2B and 3B, these level shifter circuits are two-stage level shifters.

As demonstrated above, the magnitudes of scanning lines driver pulses provided by each scanning lines driver circuit are known to be different from each other upon power-on, although it is suggested that the scanning lines driver circuits be mounted on the opposing two sides of the display panel and the scanning lines are driven from both sides of the display panel. This is because of an instability of the operation of the level shifter circuit in the driving circuit upon power-on. This invention is, therefore, attained by controlling the power-on operation of the level shifter.

Namely, as illustrated in FIGS. 2A and 3A, upon power-on, the logic-based low level standard voltage VSS, for example, 0V, and the logic-based high level standard VDD, for example, +10V, are each shifted to the TFT-based on-level GVDD, for example, +15V, and the TFT-based off-level GVSS, for example, −2V, in the level shift circuit of each stage in order to stabilize the voltage of each output line.

In detail, the sequence by which GVDD rises first as shown in FIG. 2A is obtained from the configuration shown in FIG. 2B.

In more detail, in the first level shifter 101, the logic-based high level pulse (standard VDD) is generated to provide GVDD and then shifted to the TFT-based on-level in order to produce GVDD as shown in the center of FIG. 2A. In the second level shifter 102, the logic-based low level pulse (standard VSS) is generated to provide GVSS and then shifted to the TFT-based off-level in order to produce GVSS as shown in the bottom of FIG. 2A.

Similarly, the sequence by which GVSS falls first as shown in FIG. 3A is obtained from the configuration shown in FIG. 3B.

In more detail, in the first level shifter 201, the logic-based low level pulse (standard VSS) is shifted to generate GVSS and then shifted to the TFT-based off-level in order to produce GVSS as shown in the bottom of FIG. 3A. In the second level shifter 202, the logic-based high level pulse (standard VDD) is shifted to generate GVDD and then shifted to the TFT-based on-level in order to produce GVDD as shown in the center of FIG. 3A.

Figure 4:
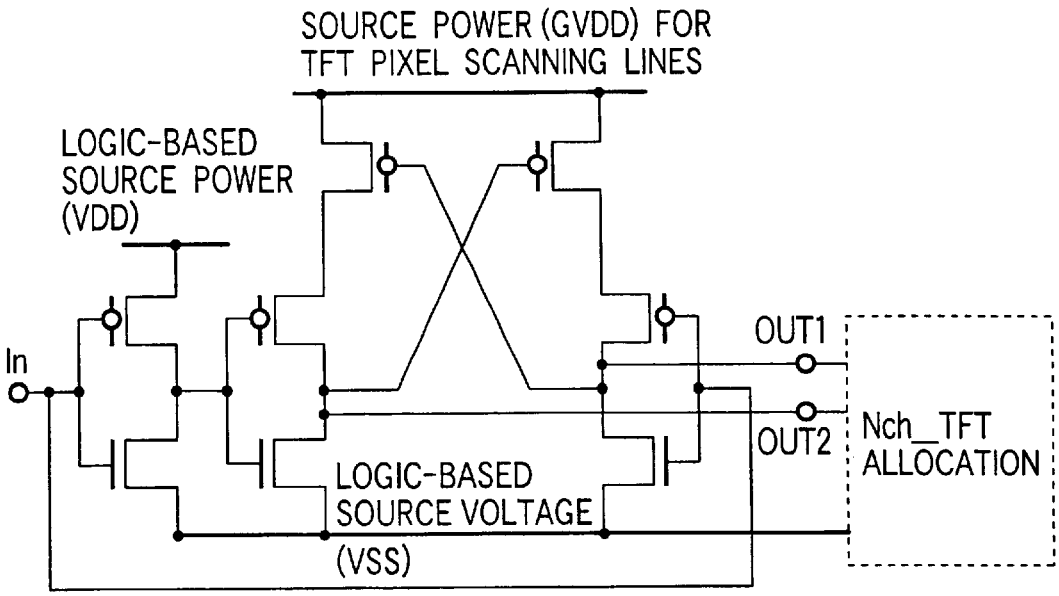
FIG. 4 is a schematic diagram of a circuit applicable to the first-stage level shifter in the two-stage level shifter shown in FIG. 2B.

FIG. 4 is a schematic diagram of a circuit applicable to the first-stage level shifter 101 in the two-stage level shifter shown in FIG. 2B.

As demonstrated in FIG. 4, the on-level TFT voltage that first rises is controlled by adding NchTFT to the output line of the first-stage level shifter and turning on the PchTFT of the second-stage level shifter, under the state with logic-based power source, namely, standard voltages VDD and VSS being maintained.

FIGS. 5, 6A to 6C are schematic diagrams illustrating an example of a two-stage level shifter where the first-stage level shifter shown in FIG. 4 has been installed and its driving method (sequence).

Figure 5:
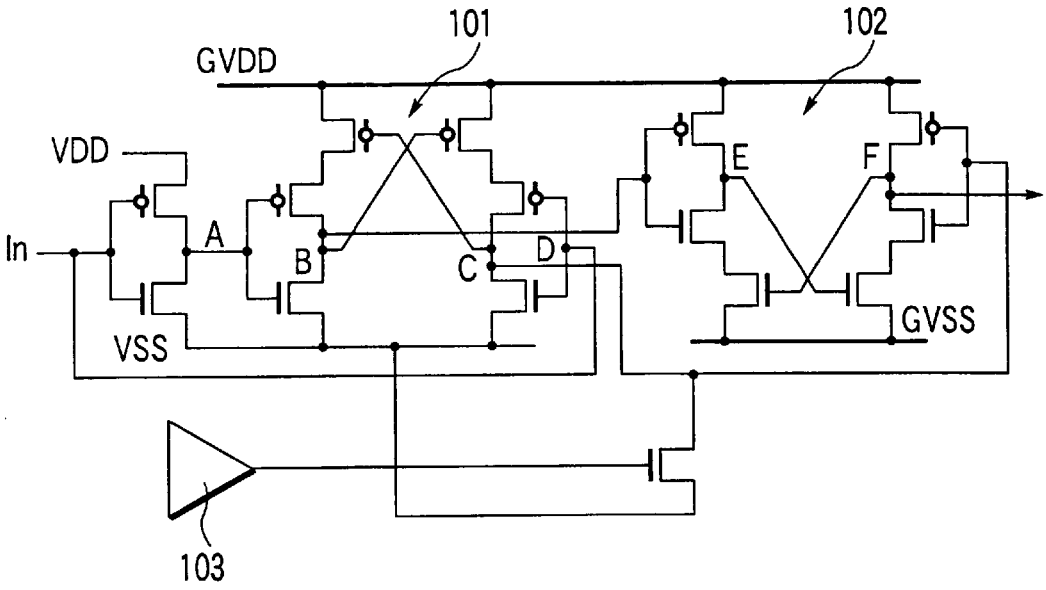
FIG. 5 is a schematic diagram of a configuration of the two-stage level shifter including the first-stage level shifter shown in FIG. 4.
Figures 6A, 6B, 6C:
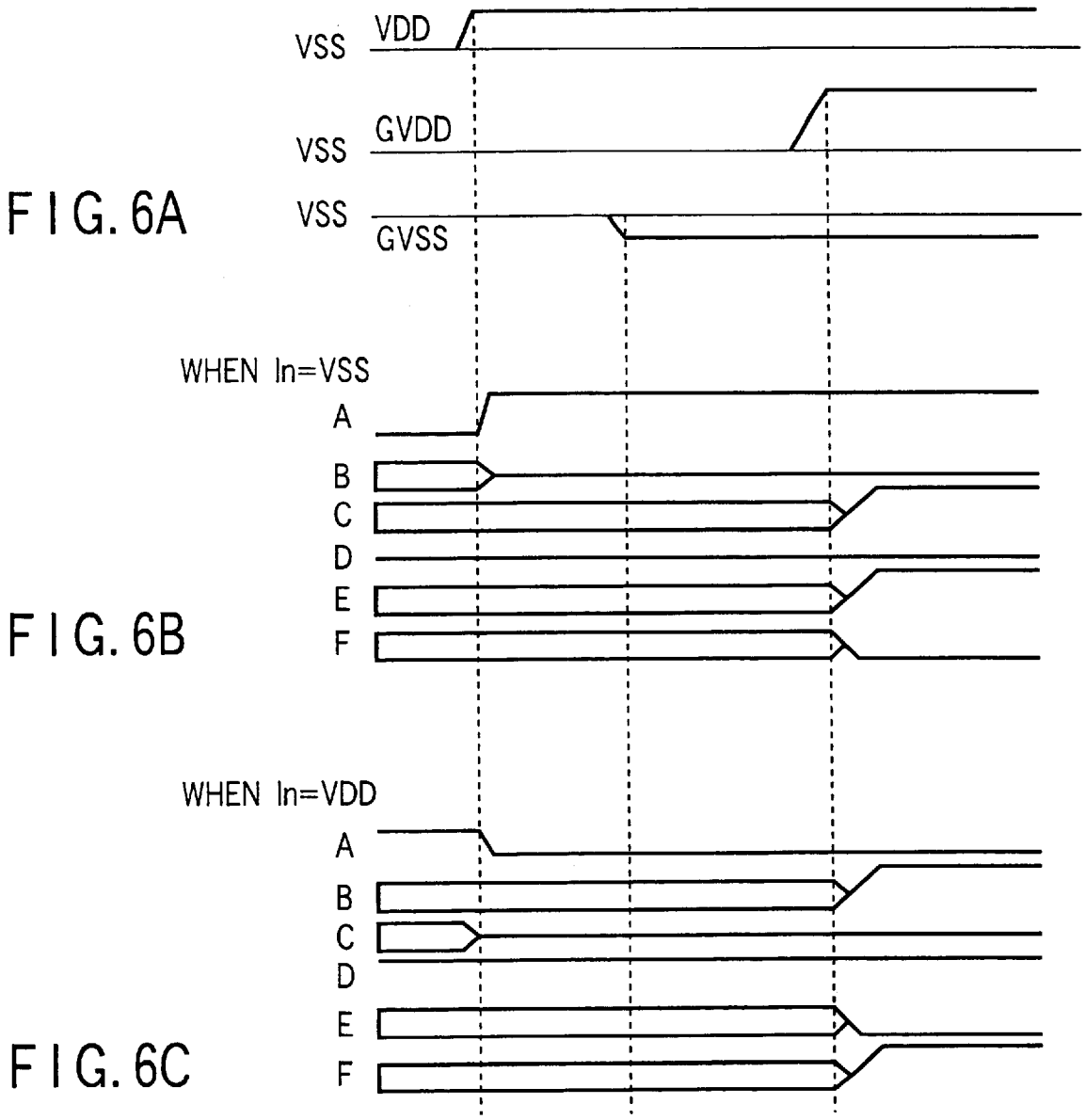
FIGS. 6A, 6B and 6C are schematic diagrams illustrating the sequence for driving the level shifter shown in FIG. 4.

In the two-stage level shifter of FIG. 5, the first-stage level shifter 101 is a step-up shifter that raises the standard voltage, and the second-stage level shifter is a step-down shifter that lowers the standard voltage. When standard voltages VSS and VDD are supplied to the circuit configuration shown in FIG. 5, the voltage supply sequence shown in FIG. 6A (the same as FIG. 2A) is attained by the outputs at A-F in FIGS. 6B and 6C. Namely, when input In is equal to the standard voltage VSS, the outputs at A-F shown in FIG. 6B are produced, while the outputs at A-F shown in FIG. 6C are produced when input "In" is equal to the standard voltage VDD. When such a two-stage level shifter shown in FIG. 5 is employed, the operation starts at the moment the voltage (GVDD) that rises first based on the logic-based standard voltage becomes stable, and then the level-shifted voltage (GVDD, GVSS) are provided.

There are two kinds of circuits that can be adopted as the circuit configuration for the power source detection circuit 103. One is a circuit (shutdown circuit) where the standard voltage (VDD or VSS) is provided until all input source voltages (GVDD and GVSS) become stable; and the other circuit where the standard voltage (VDD or VSS) and the input source voltages (GVDD and GVSS) are controlled by a comparator to be stable in the scanning lines driver circuit.

Figure 7:
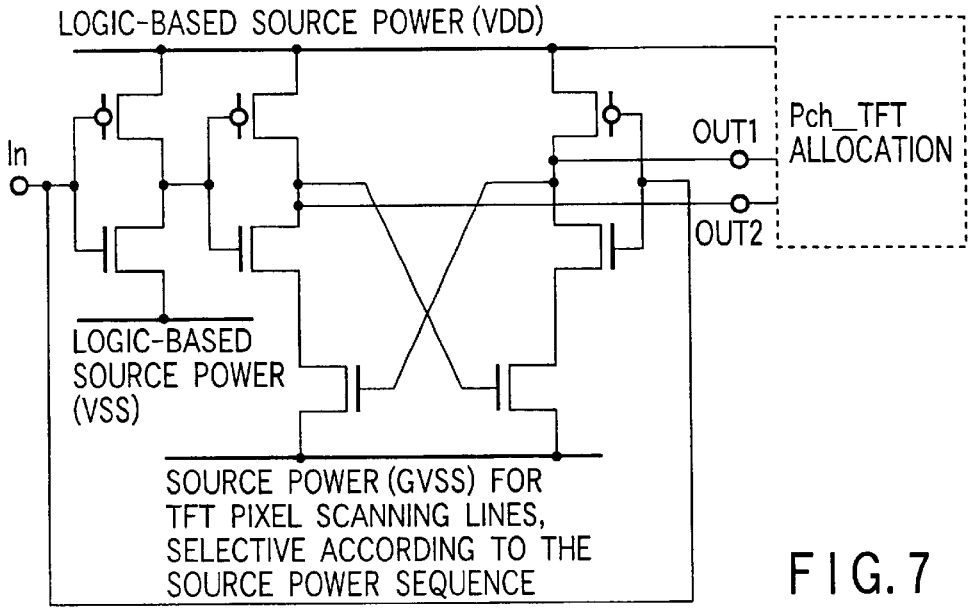
FIG. 7 is a schematic diagram of a circuit applicable to the first-stage level shifter in the two-stage level shifter shown in FIG. 3B.

FIG. 7 is a schematic diagram of a circuit applicable to the first-stage level shifter 201 in the two-stage level shifter shown in FIG. 3B.

As demonstrated in FIG. 7, the off-level TFT voltage (GVSS) that first rises is controlled by adding PchTFT to the output line of the first-stage level shifter and turning on the NchTFT of the second-stage level shifter, under the state with logic-based power source, namely, standard voltages VDD and VSS being produced.

FIGS. 8, 9A to 9C are schematic diagrams illustrating an example of the circuit of a two-stage level shifter where the first-stage level shifter shown in FIG. 7 has been installed and its driving method (sequence).

Figure 8:
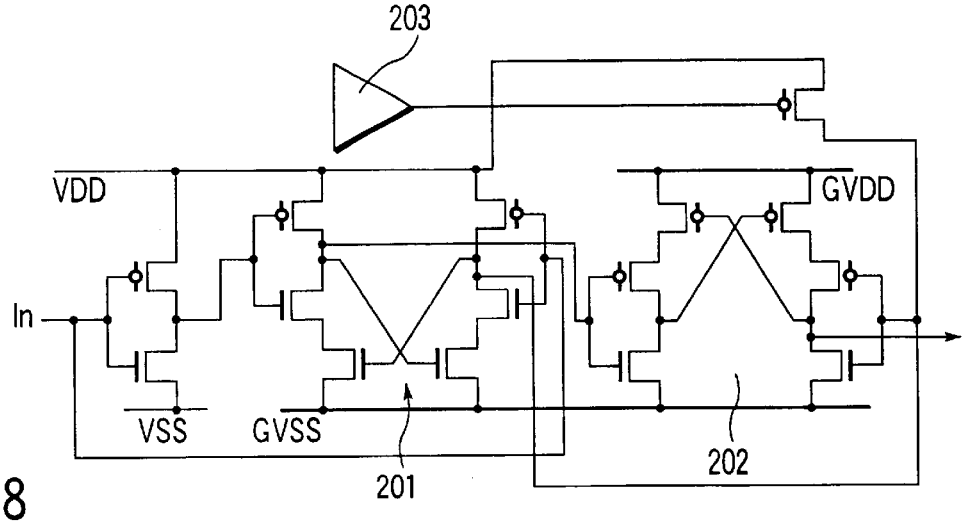
FIG. 8 is a schematic diagram of a configuration of the two-stage level shifter including the first-stage level shifter shown in FIG. 7.
Figure 10:
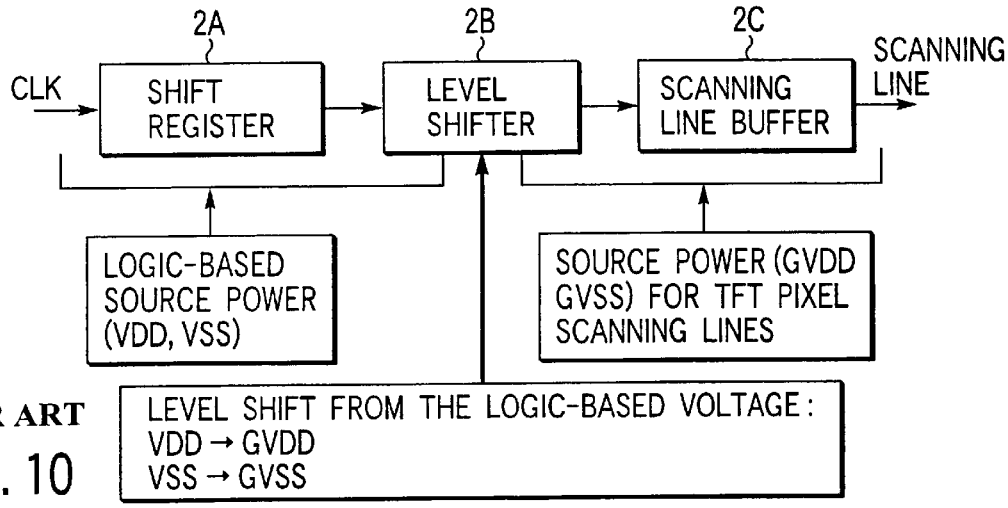
PRIOR ART FIG. 10
FIG. 10 is a schematic diagram illustrating an example of the configuration of a scanning lines driver circuit used as the conventional scanning lines driver circuit.
Figures 9A, 9B, 9C:
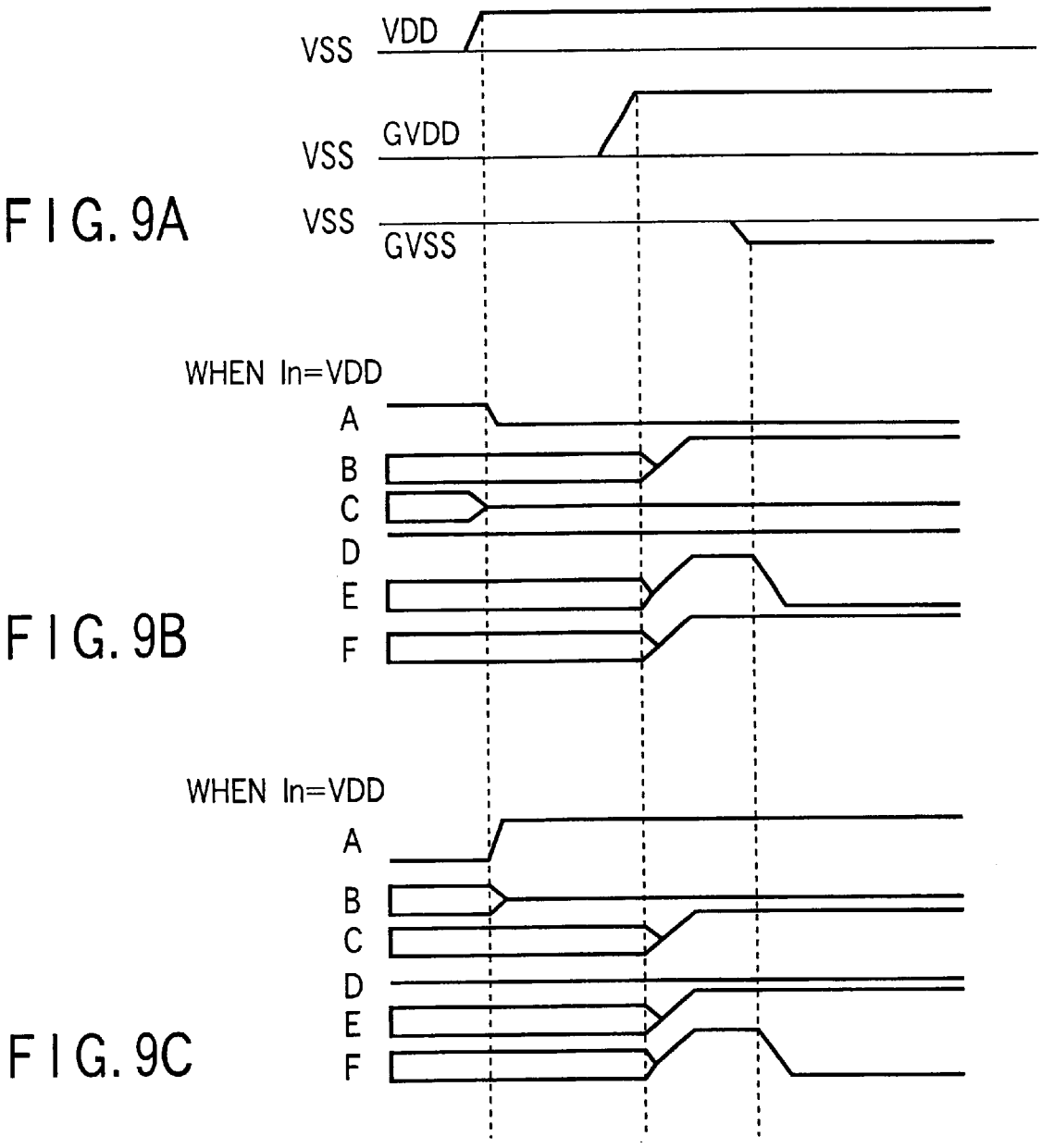
FIGS. 9A, 9B and 9C are schematic diagrams illustrating the sequence for driving the level shifter shown in FIG. 7.
Figure 11:
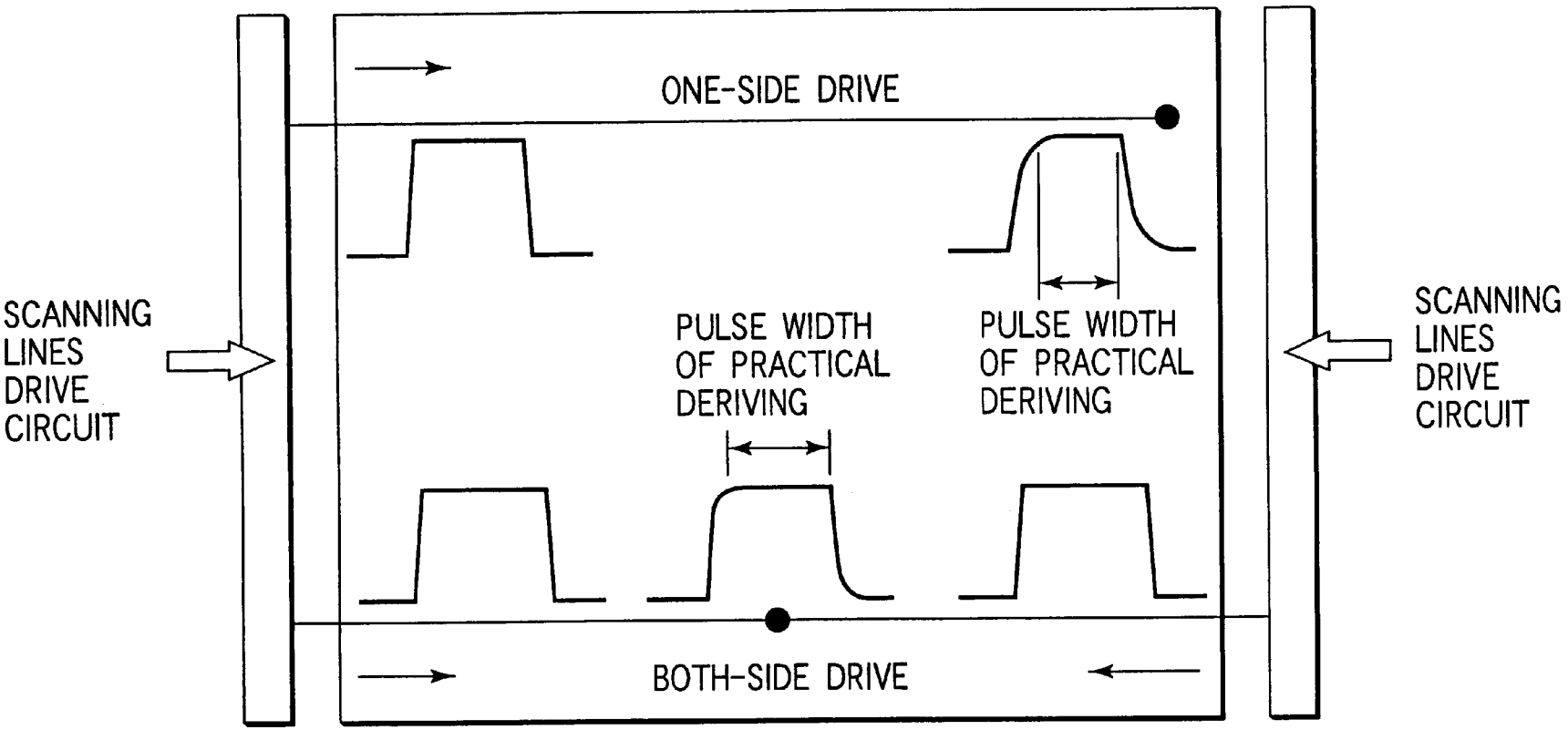
FIG. 11 PRIOR ART
FIG. 11 is a schematic diagram illustrating an example of the conventional display using the prior-art display panel where the conventional scanning lines driver circuits shown in FIG. 10 are mounted on both sides of the panel.

In the two-stage level shifter of FIG. 8, the first-stage level shifter 201 is a step-down shifter that lowers the standard voltage, and the second-stage level shifter is a step-up shifter that raises the standard voltage. When standard voltages VSS and VDD are supplied to the circuit configuration shown in FIG. 8, the voltage supply sequence shown in FIG. 9A (the same as FIG. 3A) is attained by the outputs at A-F in FIGS. 9B and 9C. Namely, when input In is equal to the standard voltage VDD, the outputs at A-F shown in FIG. 9B are produced, while the outputs at A-F shown in FIG. 9C are produced when input "In" is equal to the standard voltage VSS. When such a two-stage level shifter shown in FIG. 7 is employed, the operation starts at the moment the voltage (GVSS) that rises first based on the logic-based standard voltage becomes stable, and then the level-shifted voltage (GVDD, GVSS) are provided.

There are two kinds of circuits that can be adopted as the circuit configuration for the power source detection circuit 203. One is a circuit (shutdown circuit) where the standard voltage (VDD or VSS) is provided until all input source voltages (GVDD and GVSS) become stable; and the other circuit where the standard voltage (VDD or VSS) and the input source voltages (GVDD and GVSS) are controlled by a comparator to be stable in the scanning lines driver circuit.

As described above, the scanning lines driver circuit according to the present invention can stabilize the operation of the level shifter circuits by arranging transistors in parallel between the output lines after the first level shift in the two-stage level shifter circuit inside the scanning lines driver circuit, using the on-resistance of the transistors as pull-up and pull-down resistance.

The operation of level shifter circuits can also be stabilized by the installation of such two-stage level shift circuits and corresponding power-on sequences. Namely, the two-stage level shifter circuit for shifting the logic-based standard voltage to the high and low levels to be used in scanning pulses for TFT pixels is comprised of a circuit (for shifting to GVDD) that raises the logic-based high level pulse voltage (VDD) to TFT pixel on-level voltage and a circuit (for shifting to GVSS) that lowers the logic-based low level pulse voltage (VSS) to TFT pixel off-level voltage.

Further, a stable rise operation is enabled by a configuration inserting NchTFT in the output lines in the first-stage level shifter in parallel in order to shift the logic-based high level pulse standard voltage to the TFT pixel on-level voltage (GVDD) in the first stage level shift when the TFT pixel on-level voltage (GVDD) is first raised and then the TFT pixel off-level voltage (GVSS) is raised.

Further, a stable rise operation is enabled by a configuration inserting PchTFT in the output lines in the first-stage level shifter in parallel in order to shift the logic-based low level pulse standard voltage to the TFT pixel off-level voltage (GVSS) in the first stage level shift when the TFT pixel off-level voltage (GVSS) is first raised and then the TFT pixel on-level voltage (GVDD) is raised.

According to the present invention, as described above, since the order of level shifting is changed to match the source power turning-on sequence and transistors are inserted in parallel in the output lines of which voltages are level-shifted in the first stage, a stable operation of the scanning lines driver circuit can be guaranteed. Since such a circuit is obtained by a combination of existing circuit components and a slight addition of devices, the circuit cost does not become high.

As described above, in the present inventory, transistors are inserted between the output lines of which voltage levels have been shifted at the first stage in the two-stage level shifter installed inside the scanning lines driver circuit, and the signals controlling those transistors are kept ON until the rise of supplied source power is completed and then turned off when the source power has been supplied. As a result, the operation of the level shifter circuit is stabilized, preventing induction of undesired voltage upon power-on and damage to the scanning lines driver circuit and flat panel display.

Further, since the voltage provided from the scanning lines driver circuit is stabilized, a scanning lines driver circuit is provided that can drive flat panel displays, represented by liquid crystal displays, that can show large images with high resolution at high speeds. As a result, large and high-resolution images are provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A flat display driving method for a flat panel display having a plurality of signaling and scanning lines, pixel electrodes electrically connected to the signaling lines via switching devices connected to the scanning lines, and a first scanning lines driver circuit and a second scanning lines driver circuit that output in sequence scanning pulses including high and low levels of voltage, comprising the steps of:

shifting a first standard voltage to a first voltage by a first level shifter circuit; and controlling the operation of a second level shifter circuit when a second standard voltage is shifted to a second voltage by a second level shifter circuit, wherein said second level shifter circuit is operated by said first voltage.

* * * * *